US007798795B2

(12) United States Patent
Stündl et al.

(10) Patent No.: US 7,798,795 B2
(45) Date of Patent: Sep. 21, 2010

(54) METHOD AND APPARATUS FOR FORMING A NON-WOVEN WEB BY DEPOSITION OF SYNTHETIC FILAMENTS

(75) Inventors: Mathias Stündl, Wedel (DE); Mathias Gröner-Rothermel, Neumünster (DE)

(73) Assignee: Saurer GmbH & Co. KG

( * ) Notice: Subject to any disclaimer, the term of this patent is extended or adjusted under 35 U.S.C. 154(b) by 907 days.

(21) Appl. No.: 11/371,301

(22) Filed: Mar. 8, 2006

(65) Prior Publication Data

US 2006/0202383 A1 Sep. 14, 2006

(30) Foreign Application Priority Data

Mar. 12, 2005 (DE) ..... 10 2005 011 472

(51) Int. Cl.
*D01D 5/092* (2006.01)

(52) U.S. Cl. ..... 425/72.2; 264/103; 264/211.14; 264/211.22

(58) Field of Classification Search ..... 425/72.2; 264/103, 211.14, 211.22
See application file for complete search history.

(56) References Cited

U.S. PATENT DOCUMENTS 4,343,639 A * 8/1982 Muschelknautz et al. ..... 65/458
6,132,661 A * 10/2000 Kurihara et al. ..... 264/210.7
6,183,684 B1 2/2001 Lu
6,524,521 B1 * 2/2003 Kuroiwa et al. ..... 264/555
2002/0158362 A1 10/2002 Kuroiwa et al.

FOREIGN PATENT DOCUMENTS

| | | | |
|---|---|---|---|
| DE | 37 40 893 | A1 | 11/1988 |
| EP | 0 564 784 | A1 | 10/1993 |
| EP | 0 843 036 | A1 | 5/1998 |
| EP | 1 081 262 | A1 | 3/2001 |
| FR | 2 217 459 | A | 9/1974 |
| JP | 52-118069 | A | 10/1977 |
| JP | 07 207564 | A | 8/1995 |

* cited by examiner

*Primary Examiner*—Kat Wyrozebski
*Assistant Examiner*—Robert J Grun
(74) *Attorney, Agent, or Firm*—Alston + Bird LLP

(57) ABSTRACT

A method and apparatus for depositing synthetic filaments to form a non-woven web, wherein the filaments are drawn off from a spinneret through a drawing unit in a row-shaped arrangement using a feed fluid, accelerated into a guide channel and blown out as a filament stream toward an advancing deposit belt. The filament stream is deflected immediately before it impacts upon the deposit belt unilaterally in the advancing direction of the deposit belt in such a way that the filaments impact upon the deposit belt at an angle of <90°. For this purpose, a deflecting means is mounted immediately above the deposit belt.

7 Claims, 4 Drawing Sheets

METHOD AND APPARATUS FOR FORMING A NON-WOVEN WEB BY DEPOSITION OF SYNTHETIC FILAMENTS

BACKGROUND OF THE INVENTION

The present invention relates to a method and apparatus for forming a non-woven web by deposition of synthetic filaments upon an advancing deposit felt.

In the manufacturing process of a non-woven web out of synthetic fibers or filaments, a plurality of extruded filament strands have to be deposited to form a textile web as evenly as possible. The filament strands are drawn off using a feed fluid more or less after the extrusion and cool-down processes and guided to a deposit belt. For example, a generic method and also a generic apparatus are described in the U.S. Pat. No. 6,183,684, where a drawing unit is used in order to pull off the synthetic filaments from a spinneret after the extrusion process, and then draw and deposit them. For this purpose, the drawing unit comprises a guide channel that has a slot-shaped filament inlet on its top side and a slot-shaped filament outlet on its lower side. Just below the filament inlet, several fluid inlets meet the guiding channel through which a feed fluid is supplied to the guide channel under the effect of an overpressure. Due to this, the filament strands are pulled into the drawing unit and accelerated inside the guide channel and blown out through the filament outlet as a filament stream. A drawing process of the filament strands takes place simultaneously, after which the filaments are immediately collected by a deposit belt for deposit. The filaments impact on the deposit belt together with the feed fluid as a filament stream in an essentially vertical manner.

The known method and the known apparatus have proved to be especially useful to be able to generate high rates of production where the filament strands can attain speeds of up to 8,000 m/min. The filament stream generated by the drawing unit thus meets the surface of the deposit belt with relatively high energy. As a result, the individual filaments tend to get interlocked on the surface of the deposit belt.

It is an object of the present invention to provide a method and an apparatus for depositing filaments at high speeds of the generic type in which a more reliable discharge of the non-woven web from the deposit belt is ensured.

SUMMARY OF THE INVENTION

The above and other objects and advantages of the invention are achieved by deflecting the filament stream unilaterally in the advancing direction of the deposit belt immediately before they impact upon on the deposit belt in such a way that the filaments impact upon the belt at an angle of <90°.

The deflecting of the filaments is achieved by providing a deflecting means above the deposit belt by which a filament stream leaving from the guide channel is deflected unilaterally immediately before it impacts upon the deposit belt and in such a way that the filaments hit on the deposit belt at an angle of <90°.

The present invention would not have been suggested by the method and the device known from the patent publication US 2002/0158362 A1. In this known method and device, an air swirl is generated immediately after the filament stream leaves the drawing unit. The air swirl generates a traversing movement on the filaments so that the filaments are deposited irregularly in a depositing region on the surface of the deposit belt. For this purpose, the rotatable plate provided for generating air swirls is assigned directly to the outlet side of the drawing unit in order to achieve a large free distance for configuring the traversing movement in the filaments up to the deposit belt to be reached. Furthermore, such methods and devices are suitable for low filament speeds.

Likewise the method known from the patent application DE 37 40 893 A1 does not suggest the present invention. This patent application discloses a method and a device for manufacturing a spun bonded fabric in which the fibers are guided in a diffuser shaft until they are deposited. The filament stream can be controlled on both sides by swiveling pivotable plates arranged inside the diffuser shaft. However, the disadvantage of such methods and devices is that there exists an interrelation between the pivotable plates located opposite to one another that leads to unstable conditions in such a way that the filaments can be deflected either in the advancing direction of the delivery belt or against the advancing direction of the delivery belt. Furthermore, such devices are completely unsuitable to draw and deposit filaments at high speeds.

As opposed to the above, the method and the apparatus according to the present invention is based on a unilateral stable deflection of the filament stream shortly before the filaments impact upon the deposit belt. The filaments are deflected in the advancing direction of the deposit belt in such a way that the filaments impact upon the deposit belt at an angle of <90°. Thus, the filaments that are guided at high speeds can be deposited smoothly and gently onto the deposit belt. Also, depending on the angle of impact, certain portions of the kinetic energy can be integrated into the formation of a non-woven web. This effect can be used advantageously for increasing the advancing speed of the deposit belt.

A variant of the method in which the filament stream is deflected strongly in such a way that the filaments impact upon the delivery belt at an angle of <60° is particularly suitable to deposit fine filaments with high fiber speeds.

In order to deposit every filament in the most optimal manner possible, it is suggested in an advantageous embodiment of the present invention, to change the intensity of the deflection of the filament stream as a function of a process parameter or a product parameter. Here, the process parameter refers to the adjustments of the drawing units and also the deposit belt such as for example, the advancing speed of the deposit belt. Examples of product parameters that can be used include the filament titre or the deposit thickness of the non-woven web in order to carry out certain adjustments for deflecting the filament stream.

The deflection of the filament stream can be carried out using different methods before deposit. In a first method the deflection of the filament stream is brought about by a pivotable plate that extends laterally to the filaments in the region between the guide channel and the deposit belt. Thus a compulsory guide acting over a large region of the free distance is possible due to the Coanda effect on the filament stream. High deflections and thus relatively small angles of impact can thus be realized.

In a second method, the deflection of the filament stream is brought about by an additional air stream that flows transverse to the filaments in the advancing direction of the deposit belt. Thus it is possible to generate a deflection that acts on the filament stream in a very limited way and that additionally brings about a swirling of the filaments. The advantage of such a short distance for deflecting the filament stream is that the appearance of the flow on the outlet side of the drawing unit brought about by the filament discharge for stretching the filaments remains completely unaffected.

A markedly limited effective distance for deflecting the filament stream can also be achieved by a third method in that a shaped body is assigned to the filament stream immediately before the deposit of the filaments. The shaped body is held at a small distance above the deposit belt laterally next to the filaments. The Coanda effect is also used in order to achieve a deflection of the filament stream on the shaped body. The shaped body that dips into the boundary layer of the filament stream comprises a strong flow in the deflection direction so that the air stream remains stuck to the surface due to the physical phenomenon discovered by the physicist Coanda and thus is deflected from its guideway.

In order to achieve the impact angle that is favorable for depositing the filaments, the filaments are drawn into the guide channel preferably with a feed fluid under the effect of an excess pressure of the range of 0.5 to 5 bar, accelerated and blown out as a filament stream.

It is possible to adjust a free distance of ≦500 mm, however it is preferable to have ≦300 mm between the filament outlet of the guide channel and the surface of the deposit belt. It is thus possible to implement very compact drawing units and deposit devices for manufacturing spun bonded fabric.

The present invention also includes an apparatus for carrying out the above described method. A deflecting means is provided adjacent the deposit belt. The filament stream leaving the guide channel is deflected by the deflecting means unilaterally in the guiding direction of the deposit belt in such a way that the filaments impact upon the deposit belt at an angle of <90°. Thus very even, reproducible filament deposits can be designed for forming the non-woven material. Even at high filament speeds, it is possible to prevent the individual filaments from getting interlocked with the deposit belt. In the case of flat impact angles of the filaments, the kinetic energy of the filaments can be advantageously used with a component in the guiding direction of the deposit belt for the formation of non-woven material.

In the preferred embodiment of the device according to the present invention in which the deflecting means is formed by an air stream generator, it is possible to generate an additional swirling of the filaments shortly before deposit in addition to the deflection of the filament stream so that special non-woven effects can be produced.

However, the deflecting means is preferably formed by a pivotable plate that extends laterally to the filaments in the region between the guiding channel and the deposit belt on the side of the deposit belt that discharges the non-woven web. The pivotable plate is arranged next to the filament stream in such a way that the outer peripheral zones of the filament stream come into contact especially with the lower region of the pivotable plate so as to generate a bending action of the filament stream by the pivotable plate brought about by the so-called Coanda effect.

For this purpose, the pivotable plate advantageously comprises a free guiding end that is adjacent to the deposit belt and that is designed with an inclination that is aligned with the advancing direction of the deposit belt. The pivotable plate extends over the entire width of the filament stream so that all the filaments inside the filament stream attain a deflection that is dependent on the pivotable plate and the filament stream.

In order to prevent turbulent flow inside the filament stream as much as possible, the pivotable plate is designed preferably with a curvature in the flow direction of the filament stream. The curvature has a bending radius that is larger than half the distance between the deposit belt and the filament outlet of the drawing unit. Thus the appearances of swirls generated by the guide channel directly below the draw-off nozzle device for drawing the filaments remains unaffected and only after a progressive movement, the filament stream arrives into the sphere of influence of the bent pivotable plate.

In case of particularly short distances between the drawing unit and the deposit belt, the deflecting means can also be advantageously designed by a shaped body that extends laterally to the filaments at a small distance above the deposit belt on the side of the deposit belt that cools down the non-woven web. The shaped body is held with its outer contour to the filament stream in such a way that a deflection of the filament stream and thus of the filaments occurring due to the Coanda effect sets in. Round or elliptically shaped rods can be used as shaped bodies.

In a preferred embodiment of the apparatus according to the present invention, the position of the deflecting means can be changed in distance and height relative to the filament stream for changing the intensity of the deflection of the filament stream and thus for changing the impact angle between the filaments and the deposit belt. However, such a position change of the deflecting means can also be advantageously used for this purpose, if the distance between the filament outlet and the drawing unit and the deposit belt can be adjusted using a height adjustable drawing unit.

Due to the gentle deposit, preferably very short distances can be adjusted between the filament outlet of the drawing unit and the deposit belt. Thus distances of <500 mm or even <300 mm are possible. Very short spinning distances can be implemented in one plant. However, even distances between the drawing unit and the deposit belt of >500 mm can also be implemented.

In order to be able to carry out the drawing of the filaments that is required essentially before the deposit, the fluid inlets of the guide channel are preferably connected to a source of compressed air through which compressed air having an over-pressure of 0.5 to 5 bar can be generated.

The method according to the present invention and also the apparatus according to the present invention are characterized by a high speed deposit of the filaments so as to enable the manufacture of a non-woven web using high production speeds. Depending on the filament type, filament material and the requirements of the non-woven web, it is possible carry out the desired adjustments for deflecting the filament stream. It is also possible to carry out the adjustments using controllable actuators that are controlled automatically, for example by means of control equipment after specifying the process parameters or product parameters.

BRIEF DESCRIPTION OF THE DRAWINGS

The method and apparatus according to the present invention are explained in more detail in the following description with reference to several embodiments of the invention with reference to the attached figures, of which.

DETAILED DESCRIPTION OF THE PREFERRED EMBODIMENTS

Figure 1:
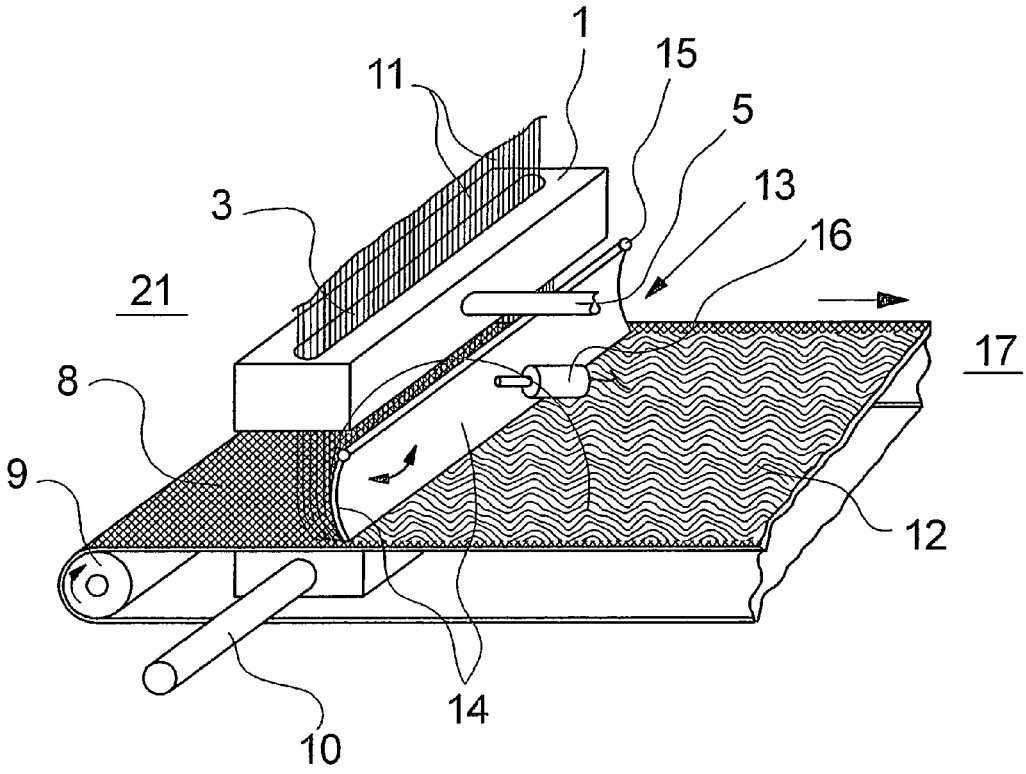
FIG. 1 is a schematic perspective view of a first embodiment of a method and apparatus according to the present invention.
Figure 2:
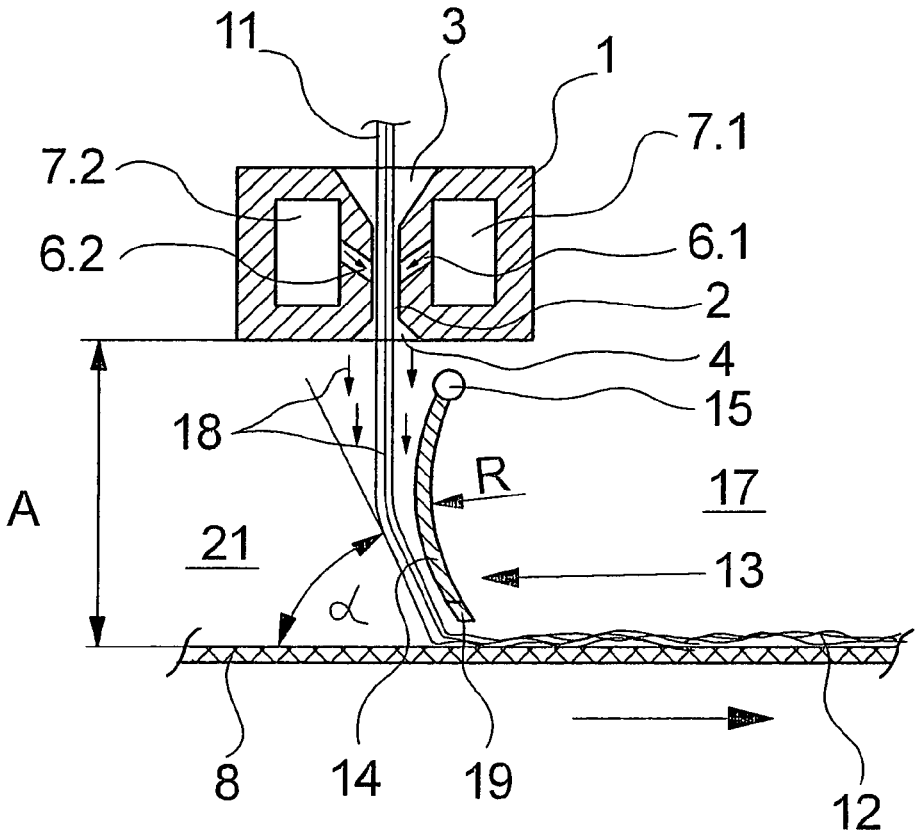
FIG. 2 is a cross-sectional view of the embodiment shown in FIG. 1.

FIGS. 1 and 2 illustrate a first embodiment of apparatus according to the present invention for depositing synthetic filaments to form a non-woven web. FIG. 1 schematically illustrates the embodiment in one view and FIG. 2 schematically illustrates the embodiment in its cross-sectional view.

As long as no reference is made to any of the Figures, the following description shall hold good for both the Figures.

The illustrated embodiment comprises a drawing unit 1 that is usually arranged below a spinneret. Such drawing units are generally known and are explained in more detail in, for example, the U.S. Pat. No. 6,183,684 B1. In this respect, reference can be made to the mentioned document for a more detailed description and only its essential components are mentioned below.

The drawing unit 1 comprises a central guide channel 2 that includes a filament inlet 3 at its upper end and a filament outlet 4 at its lower end. The guide channel 2 is designed with a slot shape and stretches essentially over the entire length of the cuboid drawing unit 1. Fluid inlets 6.1 and 6.2 are designed on the longitudinal sides of the guide channel 2, and the fluid inlets meet the guide channel 2 in a fluid-jet shaped manner. The fluid inlets 6.1 and 6.2 are connected to fluid chambers 7.1 and 7.2 that are connected to a fluid source (not illustrated) using a fluid connection 5. A feed fluid is supplied to each of the fluid chambers 7.1 and 7.2 through the fluid source using the fluid connection 5. The feed fluid has an over-pressure as compared to the atmosphere in the guiding channel 2.

The drawing unit 1 is arranged at a short distance above the deposit belt 8. The deposit belt 8 has a width that extends over the entire length of the drawing unit 1. The deposit belt 8 is preferably advanced and driven as an endless belt over several feed rollers so that the deposit belt 8 moves continuously in an advancing direction that is indicated in the Figures with an arrow. Only one of the feed rollers is illustrated in FIG. 1 and which is indicated with the reference numeral 9. The deposit belt 8 is designed to be permeable to air whereby exhaust equipment 10 is arranged on the lower side of the deposit belt 8 in a deposit region designed vertically below the drawing unit 1.

A free distance is formed in the region between the drawing unit 1 and the deposit belt 8. A deflecting means 13 is arranged inside the free distance slightly above the deposit belt 8. The deflecting means 13 is formed by a shaped pivotable plate 14 that is supported on the outflow side 17 of the deposit belt 8. The side of the deposit belt 8 relative to the drawing unit 1 is referred to as the outflow side 17. The opposite side is referred to as inflow side 21.

The pivotable plate 14 is supported at its upper end on a swivel axis 15 and can be adjusted using an actuator 16 relative to a filament stream 18 that leaves the filament outlet 4 vertically. The pivotable plate 14 has a curvature that is determined approximately by a bending radius R. The bending radius R is preferably selected in a dimension that is larger than half the distance between the deposit belt 8 and the filament outlet of the drawing unit 1. In FIG. 2 the distance between the drawing unit 1 and the deposit belt 8 is indicated by the letter A. Thus the following holds true for the bending radius R of the pivotable plate: $R \geqq A/2$.

The pivotable plate 14 projects to a point closely adjacent the deposit belt 8 with its lower guiding end 19. The distance between the guiding end 19 and the deposit belt 8 is selected in such a way that there is no contact between the pivotable plate 14 and a non-woven web 12 formed on the deposit belt 8. The guiding end 19 is designed with an inclination in the advancing direction of the deposit belt 8. The distance between the pivotable plate 14 and the filament stream generated by the drawing unit 1 is measured in such way that at least the peripheral zones of the filament stream 18 can come into contact with the surface of the pivotable plate 14. The contact region between the filament stream 18 and the pivotable plate 14 can be changed by adjusting the pivotable plate 14 relative to the swivel axis 15.

In the operating state, a feed fluid is supplied to the drawing unit 1. Preferably compressed air from a source of compressed air is used as the feed fluid. The compressed air flows into the guiding channel 2 preferably with an over-pressure in the range of 0.5 to 5 bar, preferably in the range of 1 to 3 bar from the fluid chambers 7.1 and 7.2 using the fluid inlets 6.1 and 6.2. Thus the filaments 11 merging into the guide channel 2 via the filament inlet 3 are continuously drawn off from a spinneret that is not illustrated here. In the spinneret the filaments are melt-spun from a polymer material and downwardly advance in a row-shaped arrangement and are then cooled down. The filaments 11 are accelerated inside the guide channel 2 by the feed fluid and are blown out together through the filament outlet 4 as a filament stream 18.

The filament stream 18 that is composed of the filaments and the feed fluid is blown vertically through the filament outlet 4 toward the deposit belt 8. Shortly before hitting on the deposit belt 8, the filament stream 18 arrives into the sphere of influence of the pivotable plate 14 where a deflection of the filament stream 18 occurs due to the so-called Coanda effect. The filament stream 18 nestles against the contour of the pivotable plate 14 and is deflected from the plumb line. The filaments 11 thus impact on the deposit belt 8 at an angle of <90°. The impact angle between the filaments 11 and the deposit belt 8 is indicated in FIG. 2 using the Greek letter $\alpha$. Depending on the shape of the pivotable plate 14 and the position of the pivotable plate 14 relative to the filament stream 18, it is possible to bring about a deflection that enables a filament deposit having an impact angle of <60°.

The filaments 11 form the non-woven web 12 on the surface of the deposit belt 8. The non-woven web 12 is discharged continuously from the deposit belt 8 toward the outflow side 17. By deflecting the filament stream 18 shortly before hitting on the deposit belt 8, the filaments 11 can be deposited into the non-woven web in a manner that is smooth and gentle to the filaments even at high filament speeds in the range of 3,500 m/min to 8,000 m/min. Thus high belt speeds and a high productive capacity can be implemented when manufacturing non-woven web.

By the deposit of the filaments according to the present invention, very short distances between the drawing unit 1 and the deposit belt, in the range of 50 to 500 mm, preferably 100 to 200 mm, can be implemented. It is possible to lift off the non-woven web from the deposit belt for further processing using simple means. In spite of the porous surface of the deposit belt the non-woven web can be removed from the surface using relatively small forces. There is no significant occurrence of individual fraying due to the adhesive filaments.

Figure 3:
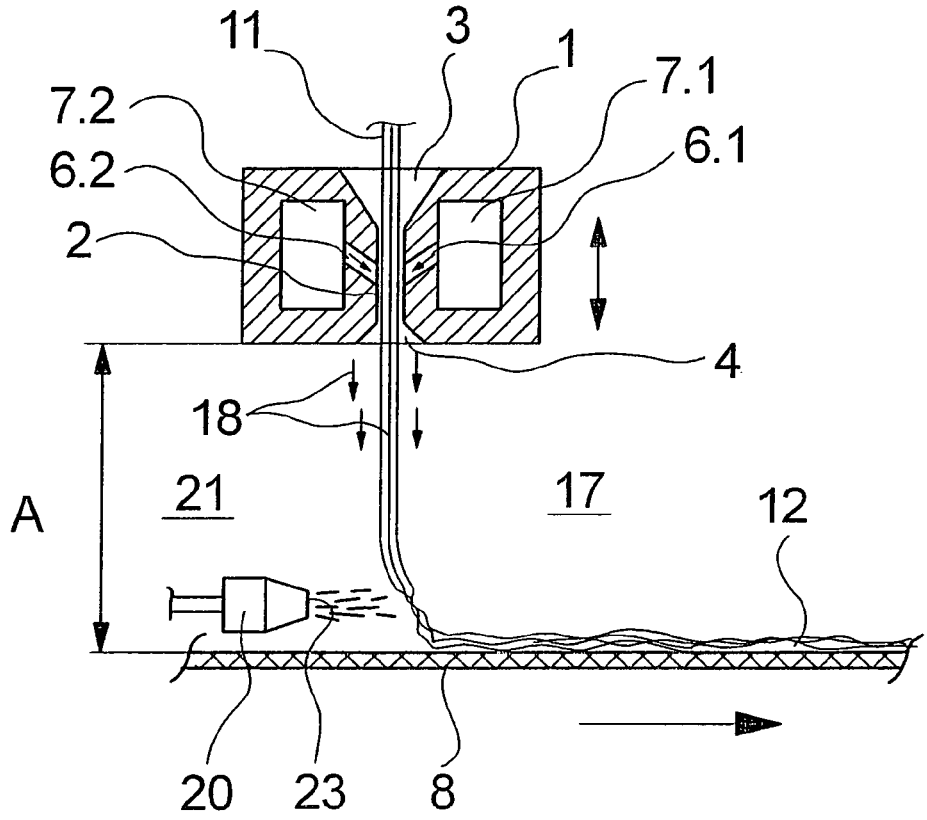
FIG. 3 and FIG. 4 each illustrate schematically a cross-sectional view of other embodiments of the method and apparatus according to the present invention.

FIG. 3 illustrates another embodiment of the apparatus according to the present invention. The embodiment illustrated in FIG. 3 is essentially identical to the previously described embodiment and only the differences are noted in the following description.

In the embodiment of the apparatus illustrated in FIG. 3, a deflecting means is arranged inside the free distance between the drawing unit 1 and the deposit belt 8 on the inflow side 21. The deflecting means is formed by an air stream generator 20 that comprises a blow opening 23 that runs essentially parallel to the filament stream 18. The air stream generator 20 is positioned adjacent the deposit belt 8 in such a way that a blow stream, which is discharged through the blow opening 23 and moves parallel to the deposit belt 8 meets the filament stream 18 shortly before the filament stream impacts upon the deposit belt 8 and leads to a deflection of the filaments in the advancing direction. In addition to the deflection of the filament stream 18, a swirling of the fibers 11 is generated shortly before deposit so that certain non-woven effects can be produced in the non-woven web 12. The intensity of the blow stream generated by the air stream generator 20 can be changed so that strong deflections can be designed with corresponding flat impact angles. The adjustments can be selected depending on the filament type and the filament titre and also the over-pressure of the fluid stream. Furthermore, the drawing unit 1 is designed to be height adjustable so that it is possible to change the distance A for designing the free distance.

Figure 4:
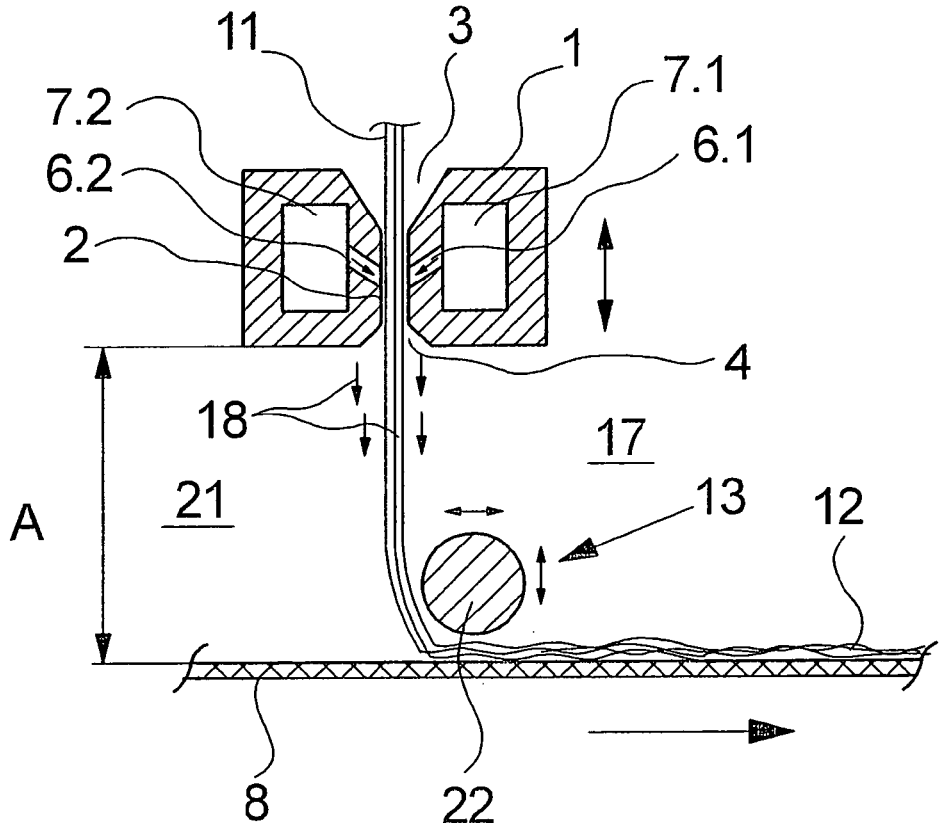

FIG. 4 illustrates schematically a cross-sectional view of another embodiment of an apparatus according to the present invention. The embodiment is essentially identical to the aforementioned embodiments. Consequently, only the differences are mentioned below.

In the embodiment illustrated in FIG. 4, the deflecting means 13 is formed by a shaped body 22. The shaped body 22 is arranged on the outflow side 17 slightly above the deposit belt 8 and extends laterally next to the filament stream 18. The shaped body 22 is held in such a way that the outer peripheral zones of the filament stream 18 at least come into contact with the surface of the shaped body 22. As illustrated, the shaped body 22 has a round rod-shaped form. Due to the Coanda effect, the filament stream 18 is deflected on the surface of the body 22 so that the fibers 11 hit on the deposit belt at an angle of <90°. The body 22 is adjustably held in a machine frame whereby it is possible to change both the distance to the deposit belt 8 and also the distance to the fiber filament 18. The body 22 could also be designed with an asymmetrical shape with a unilateral curvature that leans towards the filament stream 18. What is essential here is that the peripheral zones of the filament stream 18 come into contact with the body 22.

The embodiments of the apparatus according to the present invention illustrated in FIGS. 1 to 4 for carrying out the method according to the present invention are examples of the design and arrangement of the deflecting means. What is essential here is that the filaments are deflected in the advancing direction of the deposit belt shortly before they impact upon the deposit surface. The filaments are typically supplied vertically to the deposit belt. Especially those deflecting means are suitable that bring about a stable and reproducible deflection of the filament stream and thus an even filament deposit.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. An apparatus for depositing synthetic filaments on an advancing deposit belt to form a non-woven web, comprising a drawing unit arranged below a filament spinneret and comprising a guide channel having a slot-shaped filament inlet and a slot-shaped filament outlet, a plurality of fluid inlets communicating with the guide channel and which are connected to a fluid source, and so that the fluid and entrained filaments leave the guide channel through the filament outlet as a filament stream, a deposit belt arranged below the filament outlet with a free distance (A) between the filament outlet and the deposit belt, with the deposit belt being driven for movement in a direction transverse to the filament outlet, and deflecting means for deflecting the filament stream leaving the filament outlet unilaterally in the advancing direction of the deposit belt in such a manner that the filaments impact upon the deposit belt at an angle of <90° due to a Coanda effect, wherein the deflecting means comprises a shaped body that extends laterally to the filaments above the deposit belt on the side of the deposit belt upon which the filaments impact and the deflecting means extends substantially over the free distance (A) between the filament outlet and the deposit belt, wherein the deflecting means is positioned relative to the belt such that the filaments impact the belt proximate the tip of the deflecting means, and wherein the position of the deflecting means is adjustable such that its distance and height can be changed relative to the filament stream.

2. The apparatus according to claim 1, wherein the deflecting means comprises a pivotable plate that extends laterally to the filaments in the free distance (A) between the guide channel and the deposit belt on the side of the deposit belt upon which the filaments impact.

3. The apparatus according to claim 2, wherein the pivotable plate comprises a free guiding end that is adjacent the deposit belt and is designed with an inclination that is aligned with the advancing direction of the deposit belt.

4. The apparatus according to claim 1, wherein the pivotable plate has a curvature in the flow direction of the filament stream that is defined by a bending radius (R) which is larger than half the free distance (A) between the deposit belt and the filament outlet of the drawing unit.

5. The apparatus according to claim 1, wherein the free distance (A) between the filament outlet of the drawing unit and the deposit belt is <500 mm.

6. The apparatus according to claim 1, wherein the drawing unit is designed to be height adjustable for adjusting the free distance (A) between the filament outlet and the deposit belt.

7. The apparatus according to claim 1, wherein the fluid inlets which communicate with the guide channel are connected to a pneumatic source through which compressed air having an over-pressure of 0.5 to 5.0 bar can be generated.

* * * * *